US011299860B2

(12) United States Patent
Stoe et al.

(10) Patent No.: US 11,299,860 B2
(45) Date of Patent: Apr. 12, 2022

(54) MACHINE AND ACTUATOR ASSEMBLY ASSOCIATED WITH MACHINE

(71) Applicant: Caterpillar Paving Products Inc., Brooklyn Park, MN (US)

(72) Inventors: Terry Stoe, Champlin, MN (US); Aaron Matthew Case, St. Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 46 days.

(21) Appl. No.: 16/806,401

(22) Filed: Mar. 2, 2020

(65) Prior Publication Data

US 2021/0269990 A1 Sep. 2, 2021

(51) Int. Cl.

| | |
|---|---|
| ***E01C 19/00*** | (2006.01) |
| ***E01C 19/12*** | (2006.01) |
| ***E01C 19/48*** | (2006.01) |

(52) U.S. Cl.

CPC ..... *E01C 19/12* (2013.01); *E01C 19/48* (2013.01)

(58) Field of Classification Search

CPC ..... E01C 19/12; E01C 19/48
USPC ..... 404/83–118
See application file for complete search history.

(56) References Cited

U.S. PATENT DOCUMENTS 3,054,334 A * 9/1962 Barber ..... E01C 19/4853 404/108
3,636,832 A * 1/1972 Schrimper ..... E01C 19/4853 404/84.2
3,909,146 A * 9/1975 Hoffman ..... E01C 19/182 404/110
4,801,218 A * 1/1989 Musil ..... B60G 3/01 404/101
5,015,120 A * 5/1991 Brock ..... B60P 1/38 404/108
5,405,214 A * 4/1995 Campbell ..... E01C 19/48 404/105
7,568,858 B2 * 8/2009 Viitasalo ..... B02C 23/02 404/110
2004/0179895 A1 * 9/2004 Lee ..... E01C 19/48 404/101

(Continued)

FOREIGN PATENT DOCUMENTS

| | | | | |
|---|---|---|---|---|
| CN | 102767132 | | 6/2016 | |
| JP | 2008214884 | | 9/2008 | |
| WO | w02020259812 | * | 6/2019 | ..... E01C 19/48 |

*Primary Examiner* — Raymond W Addie
(74) *Attorney, Agent, or Firm* — von Briesen & Roper, s.c.

(57) ABSTRACT

A machine includes a chassis and a hopper assembly. The hopper assembly includes a hopper frame, at least one hopper, and an actuator assembly. The actuator assembly is adapted to move the at least one hopper between a raised position and a lowered position. The actuator assembly includes an actuator. The actuator includes a cylinder and a rod member. The actuator assembly also includes a first retention assembly adapted to couple the fixed end of the cylinder with the hopper frame and encapsulate the fixed end of the cylinder within a first space defined by the first retention assembly. The actuator assembly further includes a second retention assembly adapted to couple the movable end of the rod member with the at least one hopper and encapsulate the movable end of the rod member within a second space defined by the second retention assembly.

20 Claims, 7 Drawing Sheets

(56) References Cited

U.S. PATENT DOCUMENTS

2016/0176650 A1* 6/2016 Brown ..... E01C 19/48
198/311

* cited by examiner

MACHINE AND ACTUATOR ASSEMBLY ASSOCIATED WITH MACHINE

TECHNICAL FIELD

The present disclosure relates to a machine having an actuator assembly associated with the machine.

BACKGROUND

A paving machine includes a hopper assembly that receives material, such as asphalt, from a dump truck. The hopper assembly includes a front frame and a pair of hoppers. The hoppers are movable relative to the front frame between a raised position and a lowered position based on operation of actuators associated with the corresponding hoppers. The actuators are connected to the hoppers and the front frame using pins.

Further, current machines include a frame cut-out that is provided behind each of the hoppers for coupling the actuators with the respective hopper. This cut-out is generally large in size and causes material to spill inside the front frame when the hoppers are overfilled. Such material may further enter an engine compartment or a portion of the machine where pumps and valves are mounted. Accordingly, a personnel may have to clean such portions of the machine before servicing of the machine. In some situations, the cut-out may allow material, such as hot asphalt, to spill over the actuators, which is not desirable.

Moreover, the current design of the actuators require a large amount of hydraulic lifting force to effectuate a lift of the respective hoppers. Further, failure of one or more pins that connect the actuators with the respective hoppers and the front frame causes the hopper to drop down to the lowered position from the raised position, which may cause undesirable damage to the actuators and/or the hoppers.

CN Patent Publication Number 102767132 describes a supporting device and a supporting method for a hopper cylinder of a paver. In a construction process, a supporting pin of a hopper cylinder of an existing paver is always broken, so that the hydraulic cylinder and a hydraulic tube are damaged due to the fact that the design of the supporting pin is poor, normal and orderly construction of a road surface is severely affected, and the construction period is always delayed. The supporting device for the hopper cylinder of the paver comprises a paver hopper, the paver hopper is connected with the hopper overturning cylinder through a connector, the other end of the hopper overturning cylinder penetrates through a supporting pin with a through hole, is inserted in a supporting pin seat and is fixed by a bolt, and the supporting pin penetrates through a front baffle plate of the paver and the supporting pin seat. The supporting device is used for supporting the hopper cylinder of the paver.

SUMMARY OF THE DISCLOSURE

In an aspect of the present disclosure, a machine is provided. The machine includes a chassis. The machine also includes a hopper assembly. The hopper assembly includes a hopper frame. The hopper assembly also includes at least one hopper movable relative to the hopper frame between a raised position and a lowered position. A material receiving space defined by the at least one hopper is sealed relative to the hopper frame. The hopper assembly further includes an actuator assembly coupled with the hopper frame and the at least one hopper. The actuator assembly is adapted to move the at least one hopper between the raised position and the lowered position. The actuator assembly includes an actuator. The actuator includes a cylinder defining a fixed end adapted to couple with the hopper frame. The actuator also includes a rod member defining a movable end adapted to couple with the at least one hopper. The actuator assembly also includes a first retention assembly adapted to couple the fixed end of the cylinder with the hopper frame and encapsulate the fixed end of the cylinder within a first space defined by the first retention assembly. The actuator assembly further includes a second retention assembly adapted to couple the movable end of the rod member with the at least one hopper and encapsulate the movable end of the rod member within a second space defined by the second retention assembly.

In another aspect of the present disclosure, a hopper assembly is provided. The hopper assembly includes a hopper frame. The hopper assembly also includes at least one hopper movable relative to the hopper frame between a raised position and a lowered position. A material receiving space defined by the at least one hopper is sealed relative to the hopper frame. The hopper assembly further includes an actuator assembly coupled with the hopper frame and the at least one hopper. The actuator assembly is adapted to move the at least one hopper between the raised position and the lowered position. The actuator assembly includes an actuator. The actuator includes a cylinder defining a fixed end adapted to couple with the hopper frame. The actuator also includes a rod member defining a movable end adapted to couple with the at least one hopper. The actuator assembly also includes a first retention assembly adapted to couple the fixed end of the cylinder with the hopper frame and encapsulate the fixed end of the cylinder within a first space defined by the first retention assembly. The actuator assembly further includes a second retention assembly adapted to couple the movable end of the rod member with the at least one hopper and encapsulate the movable end of the rod member within a second space defined by the second retention assembly.

In yet another aspect of the present disclosure, a method of operating at least one hopper associated with a hopper assembly of a machine is provided. The machine includes an actuator assembly adapted to move the at least one hopper. The method includes coupling a fixed end of an actuator of the actuator assembly with a hopper frame of the hopper assembly by a first retention assembly of the actuator assembly. The first retention assembly includes a first mechanical fastener. The method also includes coupling a movable end of the actuator with the at least one hopper by a second retention assembly of the actuator assembly. The second retention assembly includes a second mechanical fastener. The method further includes moving the at least one hopper between a raised position and a lowered position based on an operation of the actuator assembly. The method includes capturing the fixed end of the actuator within a first space defined by the first retention assembly in an event of failure of the first mechanical fastener. The method also includes capturing the movable end of the actuator within a second space defined by the second retention assembly in an event of failure of the second mechanical fastener.

Other features and aspects of this disclosure will be apparent from the following description and the accompanying drawings.

DETAILED DESCRIPTION

Figure 1:
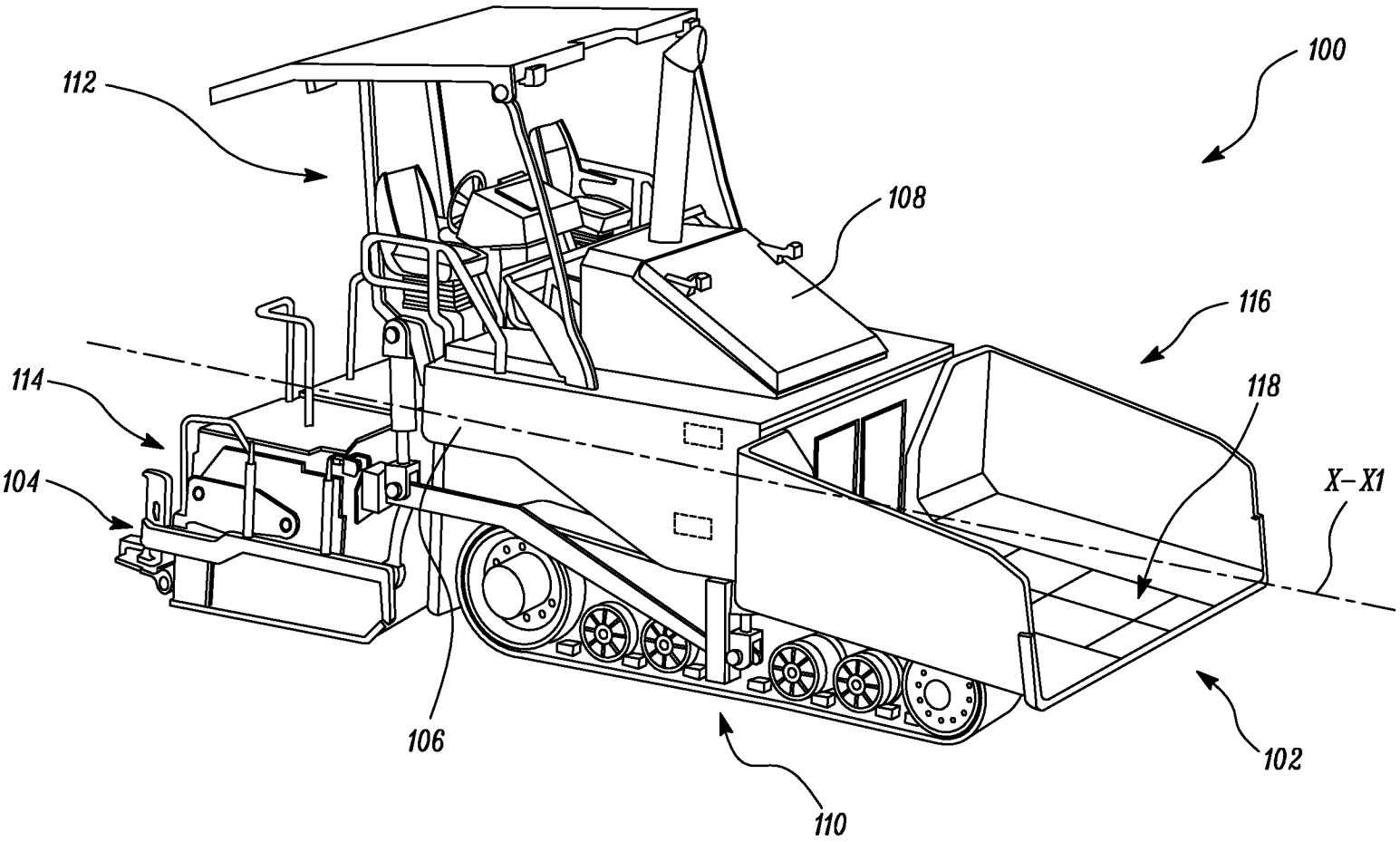
FIG. 1 is a perspective view of a machine, according to one embodiment of the present disclosure.

Wherever possible, the same reference numbers will be used throughout the drawings to refer to the same or like parts. Referring to FIG. 1, a perspective view of an exemplary machine 100 is illustrated. The machine 100 is embodied as a paver, and more particularly, an asphalt paver that may be used for laying asphalt on ground surfaces, such as a roadway. Alternatively, the machine 100 disclosed herein may be embodied for use as, for example, a concrete paving machine or another paving machine that can be used to lay other suitable aggregates of base materials known to persons skilled in the art.

The machine 100 defines a longitudinal axis "X-X1". The machine 100 defines a front end 102 and a rear end 104. The machine 100 includes a chassis 106. The chassis 106 supports various components of the machine 100 thereon. The machine 100 includes an enclosure 108 mounted on the chassis 106. The enclosure 108 encloses a power source (not shown) therein. The power source may be any power source, such as an internal combustion engine, batteries, motor, and so on. The power source provides power to the machine 100 for operational and mobility requirements.

The machine 100 also includes a set of ground engaging members 110, one of which is illustrated in the accompanying figure. The ground engaging members 110 are operably coupled to the chassis 106. In the illustrated embodiment, the ground engaging members 110 include tracks. In other embodiments, the ground engaging members 110 may include wheels, or a combination of tracks and wheels. The ground engaging members 110 support and provide mobility to the machine 100 on ground surfaces. The machine 100 also includes a machine operator station 112 mounted on the chassis 106. The machine operator station 112 is adapted to control various functions associated with the machine 100 and, in some embodiments, functions associated with a screed assembly 114 disposed proximate to the rear end 104 of the machine 100.

Further, the machine 100 includes a hopper assembly 116 mounted on the chassis 106. The hopper assembly 116 is disposed proximate to the front end 102 of the machine 100. The hopper assembly 116 receives and holds a volume of material (not shown) received from an external source (not shown), such as a truck or transfer vehicle. Further, the hopper assembly 116 transfers the material to a conveyor system 118 disposed proximate to the hopper assembly 116. The conveyor system 118 extends transversely between the first and second hoppers 122, 124. The conveyor system 118 transfers the material towards the rear end 104 of the machine 100. More particularly, the conveyor system 118 directs the material towards an auger (not shown) that is disposed proximate to the rear end 104. The auger evenly distributes the material in front of the screed assembly 114 of the machine 100. The screed assembly 114 in turn spreads and compacts the material deposited on ground surfaces.

Figure 2:
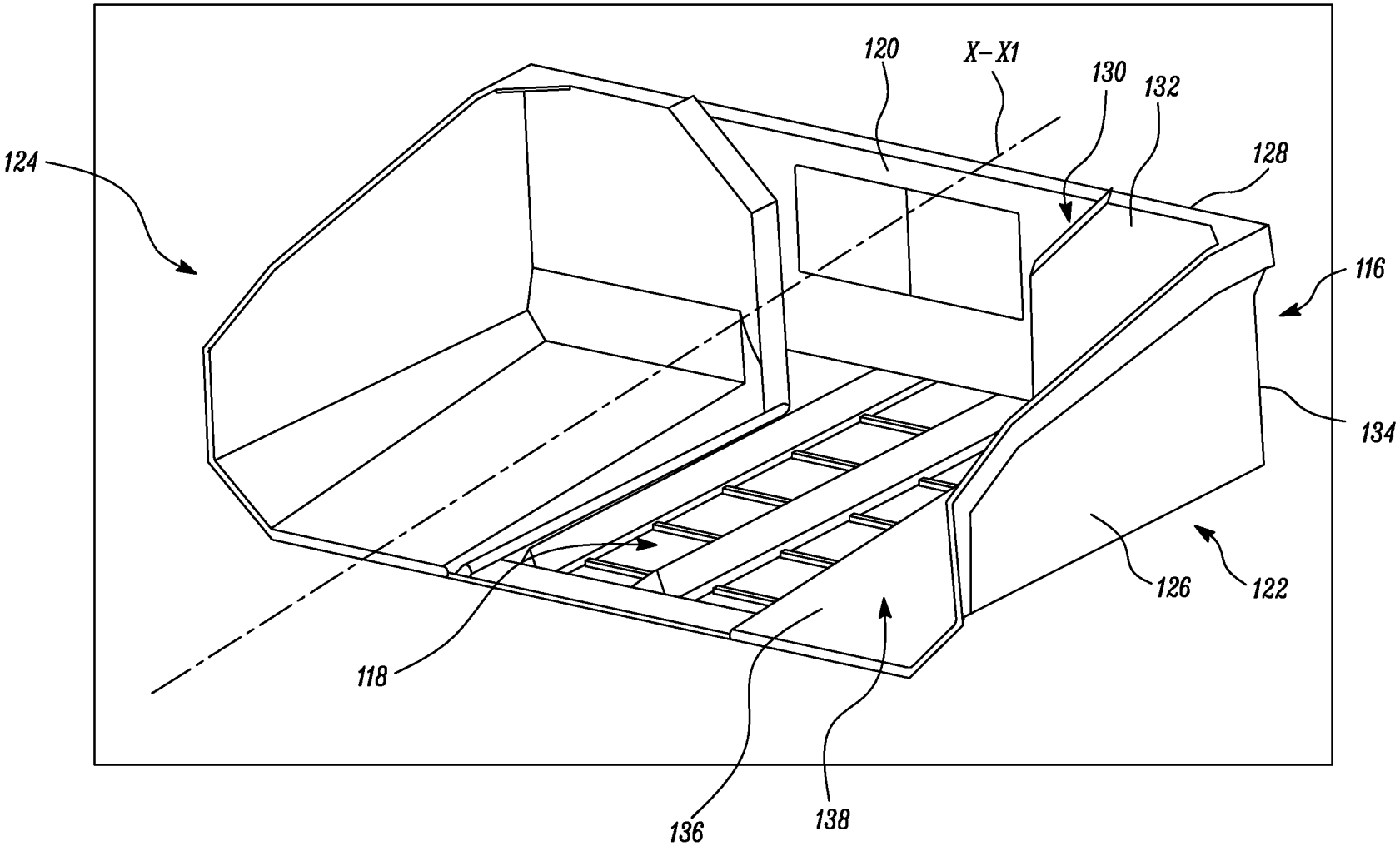
FIG. 2 illustrates a hopper assembly associated with the machine of FIG. 1.

As shown in FIG. 2, the hopper assembly 116 includes a hopper frame 120. The hopper frame 120 is supported by the chassis 106 (see FIG. 1). Further, the hopper assembly 116 includes one or more hoppers 122, 124 movable relative to the hopper frame 120 between a raised position (shown in FIG. 3) and a lowered position. The hoppers 122, 124 are shown in the lowered position in the accompanying figures. In the illustrated example, the one or more hoppers 122, 124 includes the first hopper 122 and the second hopper 124. Each of the first and second hoppers 122, 124 is movably connected to the hopper frame 120. More particularly, the first and second hoppers 122, 124 pivot relative to the hopper frame 120 between the raised and lowered positions.

It should be noted that the first hopper 122 is symmetrically disposed relative to the second hopper 124. Further, the first hopper 122 includes components and design that is similar to components and design of the second hopper 124. Thus, the description will now be explained in relation to the first hopper 122. However, it should be noted that the description provided below is equally applicable to the second hopper 124, without any limitations. The first hopper 122 includes a first sidewall 126 extending along the longitudinal axis "X-X1" defined by the machine 100.

Further, the first hopper 122 includes a second sidewall 128. The second sidewall 128 is coupled with the first sidewall 126. The second sidewall 128 extends perpendicular to the longitudinal axis "X-X1". The second sidewall 128 is perpendicular to the first sidewall 126. The second sidewall 128 is spaced apart from the hopper frame 120 to define a first gap 130 therebetween. The second sidewall 128 defines an inner surface 132 and an outer surface 134 facing the hopper frame 120 such that the first gap 130 is defined between the outer surface 134 and the hopper frame 120. Moreover, the second sidewall 128 includes a first plate member 140 (shown in FIG. 4) extending perpendicularly from the outer surface 134 of the second sidewall 128. Further, the second sidewall 128 includes a second plate member 142 (shown in FIG. 6) extending perpendicularly from the first plate member 140, such that the second plate member 142 is generally parallel to the second sidewall 128.

Figure 3:
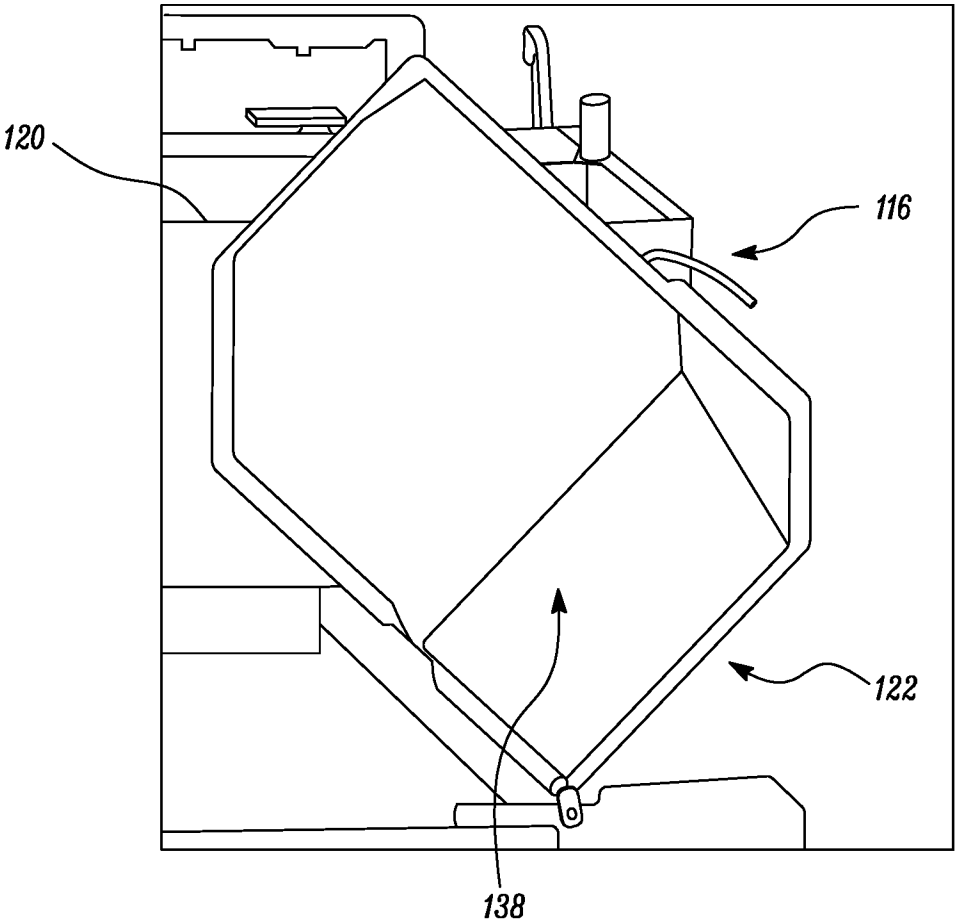
FIG. 3 illustrates a hopper of the hopper assembly of FIG. 2 in a raised position.

Moreover, the first hopper 122 includes a third sidewall 136 connected with the first and second sidewalls 126, 128. The first, second, and third sidewalls 126, 128, 136 define a material receiving space 138. Further, the material receiving space 138 defined by the first hopper 122 is sealed relative to the hopper frame 120. More particularly, the first, second, and third sidewalls 126, 128, 136 seal the material receiving space 138 relative to the hopper frame 120. It should be noted that the material received by the first hopper 122 is retained within the material receiving space 138. Further, as per application requirements, the first hopper 122 transfers the material to the conveyor system 118. More particularly, as shown in FIG. 3, the first hopper 122 moves to the raised position in order to transfer the material from the material receiving space 138 to the conveyor system 118 (see FIGS. 1 and 2).

Figure 4:
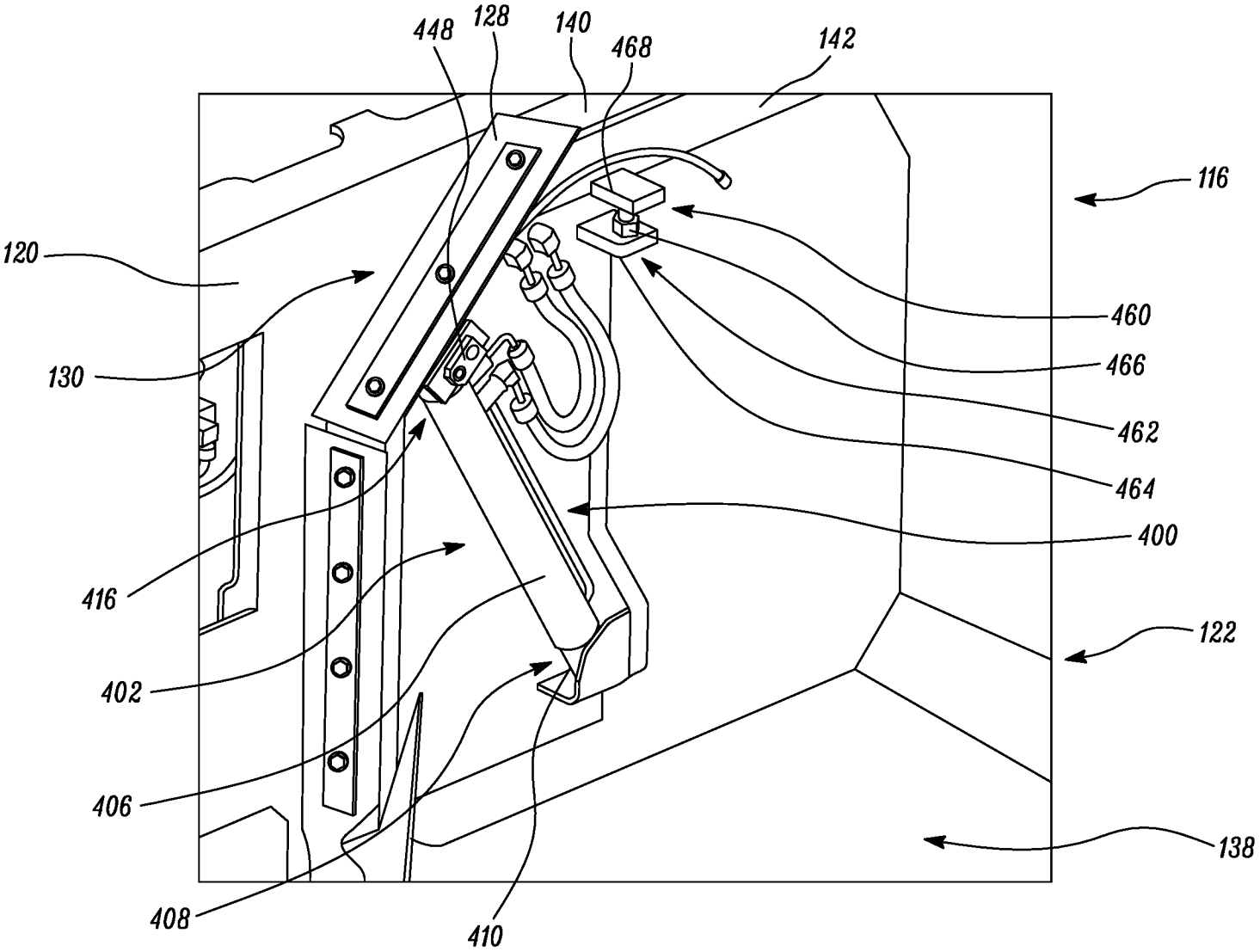
FIG. 4 illustrates an actuator assembly for moving the hopper of FIGS. 2 and 3.

FIG. 4 illustrates a portion of the first hopper 122. The second sidewall 128 is omitted herein to illustrate various components of the hopper assembly 116. Further, the present disclosure is directed towards an actuator assembly 400. More particularly, the hopper assembly 116 includes the actuator assembly 400 coupled with the hopper frame 120 and the first hopper 122. It should be noted that the hopper assembly 116 includes the first actuator assembly 400 associated with the first hopper 122 and a second actuator assembly (not shown) associated with the second hopper 124 (see FIG. 2). A construction, design, and location of the second actuator assembly is same as the first actuator assembly 400. The first actuator assembly 400 will now be explained in detail. However, the description provided below is equally applicable to the second actuator assembly, without any limitations.

The actuator assembly 400 moves the first hopper 122 between the raised position (see FIG. 2) and the lowered position. The actuator assembly 400 includes an actuator 402. The actuator 402 is positioned between the hopper frame 120 and the first hopper 122 externally relative to the material receiving space 138 defined by the first hopper 122. More particularly, the actuator 402 is positioned within the first gap 130 defined between the second sidewall 128 and the hopper frame 120. Further, the actuator 402 is spaced apart from the second sidewall 128 along the longitudinal axis "X-X1" (see FIGS. 1 and 2). More particularly, the actuator 402 is connected to the hopper frame 120 and the first hopper 122 such that a second gap 404 (shown in FIG. 6) is defined between the outer surface 134 (see FIGS. 2 and 6) of the second sidewall 128 and the actuator 402.

The actuator 402 is embodied as a hydraulically actuated actuator herein. The actuator 402 is connecting with a hydraulic system (not shown) of the machine 100 by a number of fluid lines for operation thereof. Alternatively, the actuator 402 may be embodied as a pneumatically operated actuator, as per application requirements. The actuator 402 includes a cylinder 406. The cylinder 406 defines a fixed end 408 coupled with the hopper frame 120. The fixed end 408 is fixedly coupled to the hopper frame 120. The cylinder 406 defines a hollow space (not shown). Further, a first eye end 410 is disposed proximate to the fixed end 408 of the cylinder 406. The first eye end 410 is fixedly coupled to the cylinder 406. The first eye end 410 defines a first through-hole 412 (shown in FIG. 5). Moreover, the first eye end 410 defines a first length "L1" (shown in FIG. 5).

Figure 6:
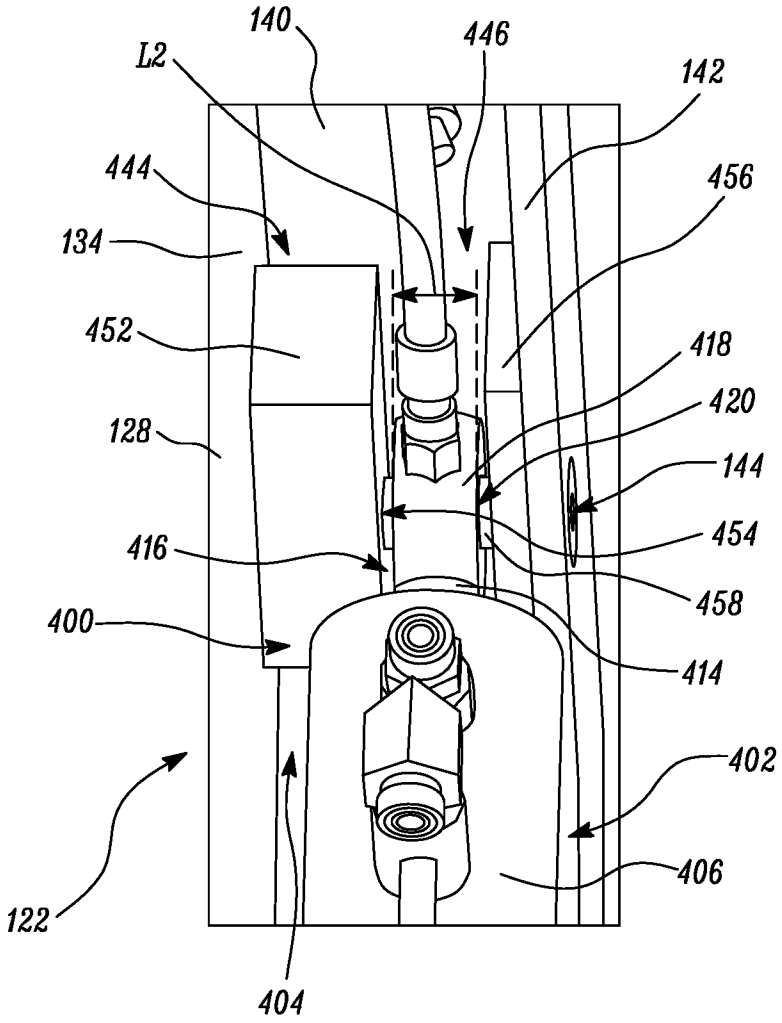
FIG. 6 illustrates a connection of the actuator assembly of FIG. 4 with the hopper.

Further, the actuator 402 includes a rod member 414 (shown in FIG. 6). The rod member 414 defines a movable end 416 coupled with the first hopper 122. The rod member 414 is slidably received within the hollow space of the cylinder 406. The rod member 414 includes a piston (not shown) mounted at an end of the rod member 414 that is opposite to the movable end 416. Further, a second eye end 418 (shown in FIG. 6) is disposed proximate to the movable end 416 of the rod member 414. The second eye end 418 is fixedly coupled to the rod member 414. The second eye end 418 defines a second through-hole 420 (shown in FIG. 6). Moreover, the second eye end 418 defines a second length "L2" (shown in FIG. 6).

The actuator 402 is shown in a retracted position in the accompanying figure. It should be noted that the actuator 402 is said to be in an extended position based on an extension of the rod member 414 relative to the cylinder 406, whereas, the actuator 402 is said to be in the retracted position based on a retraction of the rod member 414 relative to the cylinder 406. The extension of the actuator 402 causes the first hopper 122 to move to the raised position, whereas, the retraction of the actuator 402 causes the first hopper 122 to move to the lowered position.

Figure 5:
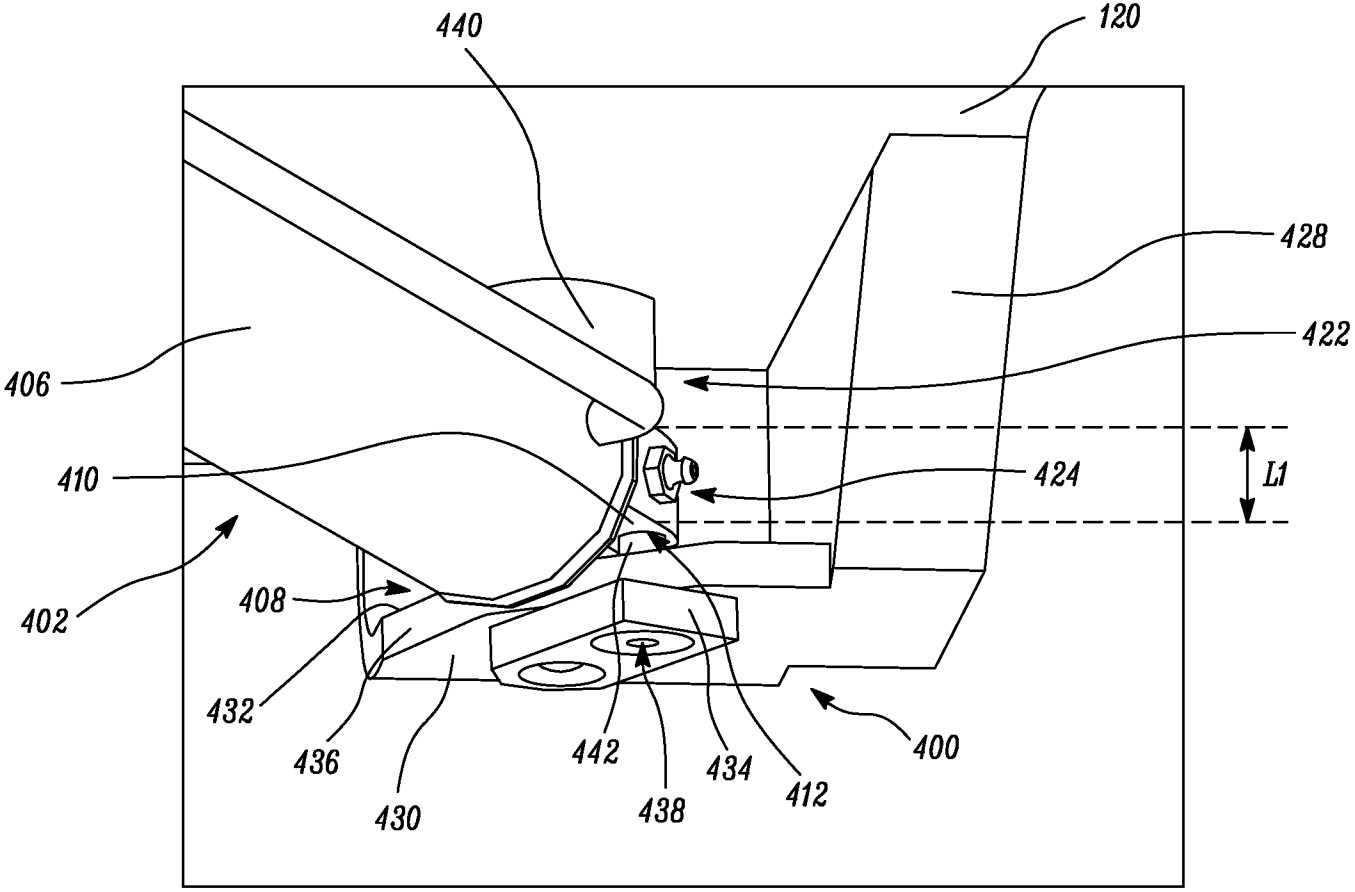
FIG. 5 illustrates a connection of the actuator assembly of FIG. 4 with a hopper frame.

Referring now to FIG. 5, the actuator assembly 400 includes a first retention assembly 422 for coupling the fixed end 408 of the cylinder 406 with the hopper frame 120. Further, the first retention assembly 422 encapsulates the fixed end 408 of the cylinder 406 within a first space 424 defined by the first retention assembly 422. A length defined by the first space 424 is approximately equal to the first length "L1" defined by the first eye end 410 so that the first eye end 410 may be captively held within the first space 424. The first retention assembly 422 includes a first plate 426 coupled with the hopper frame 120. The first plate 426 is coupled with the hopper frame 120 by a bracket 428. The first plate 426 defines a through-hole (not shown). The first plate 426 is generally parallel to the hopper frame 120. The first plate 426 defines a first surface 430 and a second surface 432.

Further, the first retention assembly 422 includes a first retention plate 434 coupled with the first plate 426. The first retention plate 434 includes a rectangular plate having a curved portion. The first retention plate 434 is coupled to the first surface 430 of the first plate 426 by a mechanical fastener (not shown), such as a pin, screw, bolt, and the like. Further, the first retention plate 434 includes a third through-hole 438 that aligns with the through-hole of the first plate 426.

The first retention assembly 422 also includes a first mount 440 coupled with the hopper frame 120. The first mount 440 is coupled with the hopper frame 120 by one or more mechanical fasteners (not shown), such as bolt, screw, pin, and the like. The first mount 440 is spaced apart from the first plate 426 to define the first space 424 therebetween. The first mount 440 is embodied as a cylindrical member defining a through-hole (not shown). Alternatively, a shape of the first mount 440 may vary as per application requirements. For example, the first mount 440 may embody a cube or a cuboid.

Further, the first retention assembly 422 includes a first mechanical fastener 442 adapted to couple the fixed end 408 of the cylinder 406 with the hopper frame 120. The third through-hole 438, the through-hole of the first plate 426, the first through-hole 412, and the through-hole of the first mount 440 are aligned to receive the first mechanical fastener 442 therethrough. The first mechanical fastener 442 is embodied as a pin herein. Alternatively, the first mechanical fastener 442 may include a bolt.

Referring now to FIG. 6, the actuator assembly 400 includes a second retention assembly 444. The second retention assembly 444 couples the movable end 416 of the rod member 414 with the first hopper 122. Further, the second retention assembly 444 encapsulates the movable end 416 of the rod member 414 within a second space 446 defined by the second retention assembly 444. A length defined by the second space 446 is approximately equal to the second length "L2" defined by the second eye end 418 so that the second eye end 418 may be captively held within the second space 446.

The second retention assembly 444 includes a second retention plate 448 (shown in FIG. 4) coupled with the second sidewall 128. The second retention plate 448 includes a rectangular plate having a curved portion. The second retention plate 448 is coupled with the inner surface 132 (see FIG. 2) of the second sidewall 128. The second retention plate 448 is coupled with the inner surface 132 by a mechanical fastener (not shown), such as a pin, screw, bolt, and the like. Further, the second retention plate 448 includes a through-hole (not shown) that aligns with a through-hole of the second sidewall 128.

The second retention assembly 444 further includes a second mount 452 coupled with the second sidewall 128. More particularly, the second mount 452 is coupled with the outer surface 134 of the second sidewall 128. The second mount 452 is coupled with the outer surface 134 of the second sidewall 128 by one or more mechanical fasteners (not shown), such as bolt, screw, pin, and the like. The second mount 452 defines a fourth through-hole 454. Further, the second retention assembly 444 includes a third mount 456 coupled with the second sidewall 128. More particularly, the third mount 456 is coupled with the second plate member 142 of the second sidewall 128. The third mount 456 is coupled with the second plate member 142 by one or more mechanical fasteners (not shown), such as bolt, screw, pin, and the like. Further, the third mount 456 is spaced apart from the second mount 452 to define the second space 446 therebetween. The third mount 456 defines a through-hole (not shown). The second and third mounts 452, 456 are cuboid in shape. Alternatively, the second and third mounts 452, 456 may be cylindrical or cube shaped.

The second retention assembly 444 includes a second mechanical fastener 458 for coupling the movable end 416 of the rod member 414 with the second sidewall 128. The through-hole of the second retention plate 448, the through-hole of the second sidewall 128, the fourth through-hole 454, the second through-hole 420, the through-hole of the third mount 456, and a through-hole 144 of the second plate member 142 are aligned to receive the second mechanical fastener 458 therethrough. The second mechanical fastener 458 is embodied as a pin herein. Alternatively, the second mechanical fastener 458 may include a bolt.

Referring now to FIG. 4, the machine 100 includes a limit stop 460. The limit stop 460 restricts the retraction of the actuator 402. More particularly, the limit stop 460 restricts the retraction of the actuator 402 beyond a predefined limit which in turn causes a travel of the first hopper 122 to be restricted. The limit stop 460 includes a first limiting member 462 coupled with the hopper frame 120. The first limiting member 462 includes a bracket member 464 coupled with the hopper frame 120. Further, the bracket member 464 defines an aperture (not shown) for receiving a third mechanical fastener 466, such as a bolt, screw, pin, and the like. A location of the first limiting member 462 relative to the hopper frame 120 is decided based on the predefined limit of retraction of the actuator 402. The location of the first limiting member 462 may vary as per application requirements.

Further, the limit stop 460 includes a second limiting member 468 coupled with the first hopper 122. The second limiting member 468 is embodied as a rectangular plate that is coupled with the second plate member 142 of the second sidewall 128. The second limiting member 468 is adapted to abut with the first limiting member 462. More particularly, when the first hopper 122 switches from the raised position to the lowered position, the second limiting member 468 abuts with the third mechanical fastener 466 of the first limiting member 462. This abutment of the first and second limiting members 462, 468 restrict any further retraction of the actuator 402, and thus the first hopper 122.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

Figure 7:
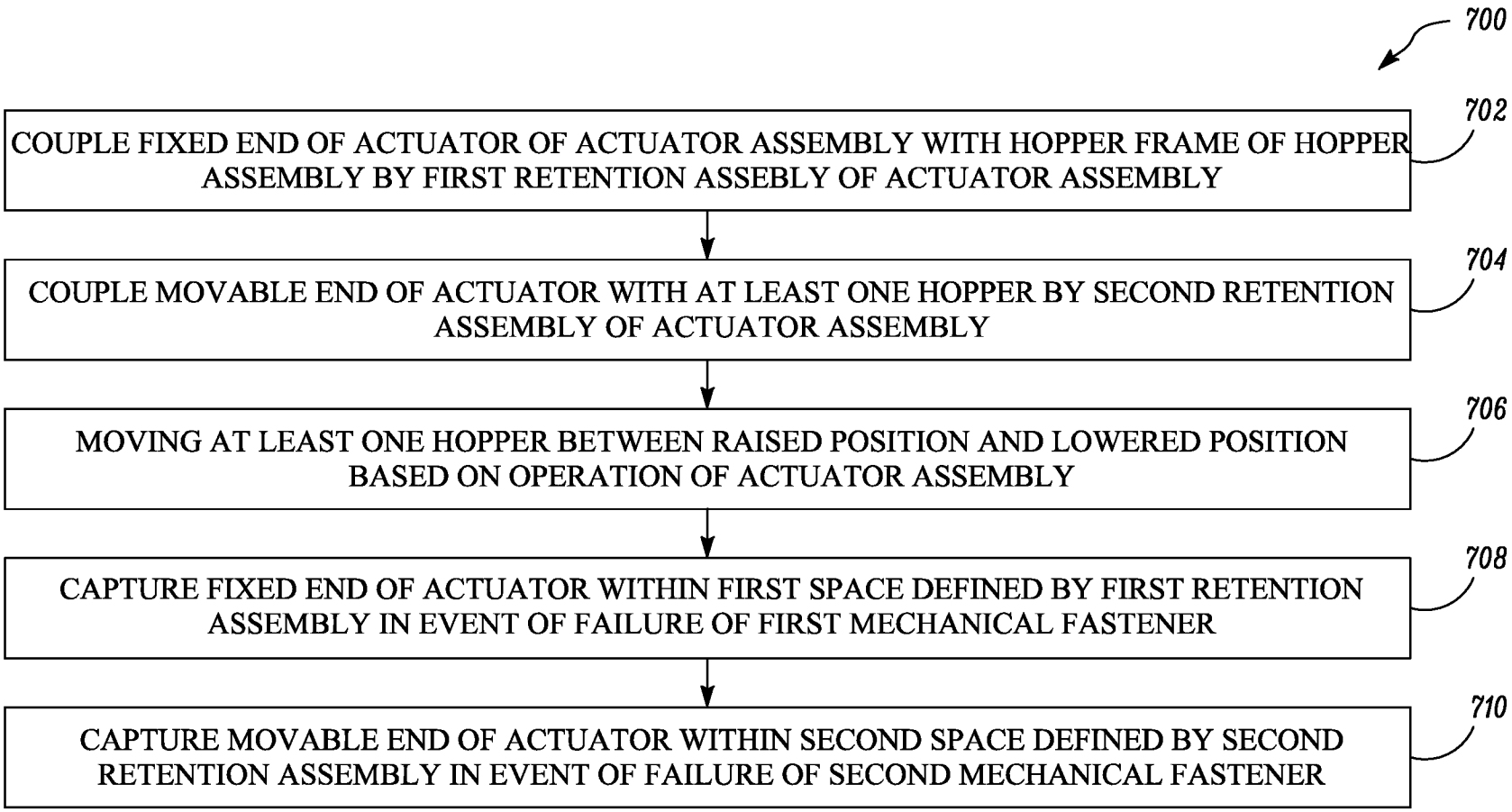
FIG. 7 is a flowchart for a method of operating the hopper of the machine.

This section will now be described in relation to the first hopper 122 and the actuator assembly 400 associated therewith. However, the description provided in this section is equally applicable to the second hopper 124 and the actuator assembly associated therewith. Referring to FIG. 7, a flowchart for a method 700 of operating the first hopper 122 associated with the hopper assembly 116 of the machine 100 is illustrated. The machine 100 includes the actuator assembly 400 that moves the first hopper 122. At step 702, the fixed end 408 of the actuator 402 of the actuator assembly 400 is coupled with the hopper frame 120 of the hopper assembly 116 by the first retention assembly 422 of the actuator assembly 400. The first retention assembly 422 includes the first mechanical fastener 442.

At step 704, the movable end 416 of the actuator 402 is coupled with the first hopper 122 by the second retention assembly 444 of the actuator assembly 400. The second retention assembly 444 includes the second mechanical fastener 458. The actuator 402 is positioned between the hopper frame 120 and the first hopper 122 externally relative to the material receiving space 138 defined by the first hopper 122. Further, the actuator assembly 400 is coupled with the hopper frame 120 and the first hopper 122 such that the actuator 402 is spaced apart from the sidewall of the first hopper 122 along the longitudinal axis "X-X1" defined by the machine 100.

At step 706, the first hopper 122 is moved between the raised position and the lowered position based on the operation of the actuator assembly 400. Moreover, the retraction of the actuator 402 beyond the predefined limit is restricted based on abutment of the first limiting member 462 coupled with the hopper frame 120 with the second limiting member 468 coupled with the first hopper 122. Further, at step 708, the fixed end 408 of the actuator 402 is captured within the first space 424 defined by the first retention assembly 422 in an event of failure of the first mechanical fastener 442. At step 710, the movable end 416 of the actuator 402 within the second space 446 defined by the second retention assembly 444 in an event of failure of the second mechanical fastener 458.

The actuator assembly 400 provides a simple, effective, and cost-efficient solution for coupling the actuator 402 with the first hopper 122 and the hopper frame 120. Further, the first hopper 122 does not include any cut-outs in the second sidewall 128 for mounting the actuator 402 to the first hopper 122. Thus, the second sidewall 128 of the first hopper 122 is sealed relative to the hopper frame 120, thereby isolating the material receiving space 138 from the engine and other components, such as pumps and valves, of the machine 100. Thus, a probability of material spillage from the first hopper 122 towards the engine or other components of the machine 100. Further, isolation of the material receiving space 138 is eliminated which in turn reduces material build-up in the machine 100 and an amount of clean-up work. Further, a probability of hot paving material to contact and damage the actuator 402 is also eliminated.

Moreover, the first and second retention assemblies 422, 444 allows encapsulation of the fixed and movable ends 408, 416, respectively, of the actuator 402 in an event of failure of the first and second mechanical fasteners 442, 458, respectively. More particularly, the fixed and movable ends 408, 416 are captured within the first and second spaces 424, 446, respectively. Thus, if the hopper 122 is in the raised position, the hoppers 122 is retained at its current position, thereby eliminating any damage to the first hopper 122 due to a sudden drop of the first hopper 122 to the lowered position. Further, the current design of the actuator assembly 400 requires less amount of hydraulic force to move the first hopper 122 between the raised and lowered positions as compared to existing actuator assemblies. Further, the limit stop 460 is associated with the machine 100. The limit stop 460 provides a protection feature for the actuator 402. More particularly, the limit stop 460 restricts a complete retraction of the rod member 414 relative to the cylinder 406.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A machine comprising:

a chassis;

a hopper assembly mounted on the chassis, wherein the hopper assembly includes:

a hopper frame;

at least one hopper movable relative to the hopper frame between a raised position and a lowered position, wherein a material receiving space defined by the at least one hopper is sealed relative to the hopper frame; and an actuator assembly coupled with the hopper frame and the at least one hopper, wherein the actuator assembly is adapted to move the at least one hopper between the raised position and the lowered position, wherein the actuator assembly includes:

an actuator including:

a cylinder defining a fixed end adapted to couple with the hopper frame; and a rod member defining a movable end adapted to couple with the at least one hopper;

a first retention assembly adapted to couple the fixed end of the cylinder with the hopper frame and configured to captively hold the fixed end of the cylinder within a first space defined by the first retention assembly, the first retention assembly including:

a first plate coupled with the hopper frame;

a first retention plate coupled with the first plate; and a first mount coupled with the hopper frame, wherein the first mount is spaced apart from the first plate to define the first space therebetween; and a second retention assembly adapted to couple the movable end of the rod member with the at least one hopper and configured to captively hold the movable end of the rod member within a second space defined by the second retention assembly.

2. The machine of claim 1, wherein the at least one hopper includes a first hopper and a second hopper.

3. The machine of claim 1, wherein the first retention assembly further includes:

a first mechanical fastener adapted to couple the fixed end of the cylinder with the hopper frame.

4. The machine of claim 1 further comprising a limit stop adapted to restrict a retraction of the actuator, the limit stop including:

a first limiting member coupled with the hopper frame; and a second limiting member coupled with the at least one hopper, wherein the second limiting member is adapted to abut with the first limiting member.

5. The machine of claim 1, wherein the at least one hopper includes:

a first sidewall extending along a longitudinal axis defined by the machine;

a second sidewall coupled with the first sidewall, wherein the second sidewall extends perpendicular to the longitudinal axis; and a third sidewall connected with the first and second sidewalls, wherein the first, second, and third sidewalls define the material receiving space.

6. The machine of claim 5, wherein the actuator is positioned between the hopper frame and the at least one hopper externally relative to the material receiving space defined by the at least one hopper.

7. The machine of claim 5, wherein the actuator is spaced apart from the second sidewall along the longitudinal axis.

8. The machine of claim 5, wherein the second retention assembly includes:

a second retention plate coupled with the second sidewall;

a second mount coupled with the second sidewall;

a third mount coupled with the second sidewall, wherein the third mount is spaced apart from the second mount to define the second space therebetween; and a second mechanical fastener adapted to couple the movable end of the rod member with the second sidewall.

9. A hopper assembly comprising:

a hopper frame;

at least one hopper movable relative to the hopper frame between a raised position and a lowered position, wherein a material receiving space defined by the at least one hopper is sealed relative to the hopper frame; and an actuator assembly coupled with the hopper frame and the at least one hopper, wherein the actuator assembly is adapted to move the at least one hopper between the raised position and the lowered position, wherein the actuator assembly includes:

an actuator including:

a cylinder defining a fixed end adapted to couple with the hopper frame; and a rod member defining a movable end adapted to couple with the at least one hopper;

a first retention assembly adapted to couple the fixed end of the cylinder with the hopper and configured to captively hold the fixed end of the cylinder within a first space defined by the first retention assembly, the first retention assembly including:

a first plate coupled with the hopper frame;

a first retention plate coupled with the first plate; and a first mount coupled with the hopper frame, wherein the first mount is spaced apart from the first plate to define the first space therebetween; and a second retention assembly adapted to couple the movable end of the rod member with the at least one hopper and configured to captively hold the movable end of the rod member within a second space defined by the second retention assembly.

10. The actuator assembly of claim 9, wherein the at least one hopper includes a first hopper and a second hopper.

11. The actuator assembly of claim 10, wherein the at least one hopper includes:

a first sidewall extending along a longitudinal axis defined by the machine;

a second sidewall coupled with the first sidewall, wherein the second sidewall extends perpendicular to the longitudinal axis; and a third sidewall connected with the first and second sidewalls, wherein the first, second, and third sidewalls define the material receiving space.

12. The actuator assembly of claim 11, wherein the actuator is positioned between the hopper frame and the at least one hopper externally relative to the material receiving space defined by the at least one hopper.

13. The actuator assembly of claim 11, wherein the actuator is spaced apart from the second sidewall of the at least one hopper along the longitudinal axis.

14. The actuator assembly of claim 9, wherein the first retention assembly further includes:

a first mechanical fastener adapted to couple the fixed end of the cylinder with the hopper frame.

15. The actuator assembly of claim 11, wherein the second retention assembly includes:

a second retention plate coupled with the second sidewall;

a second mount coupled with the second sidewall;

a third mount coupled with the second sidewall, wherein the third mount is spaced apart from the second mount to define the second space therebetween; and a second mechanical fastener adapted to couple the movable end of the rod member with the second sidewall.

16. The actuator assembly of claim 9 further comprising a limit stop adapted to restrict a retraction of the actuator, the limit stop including:

a first limiting member coupled with the hopper frame; and a second limiting member coupled with the at least one hopper, wherein the second limiting member is adapted to abut with the first limiting member.

17. A method of operating at least one hopper associated with a hopper assembly of a machine, wherein the machine includes an actuator assembly adapted to move the at least one hopper, the method comprising:

coupling a fixed end of an actuator of the actuator assembly with a hopper frame of the hopper assembly by a first retention assembly of the actuator assembly, wherein the first retention assembly includes a first mechanical fastener;

coupling a movable end of the actuator with the at least one hopper by a second retention assembly of the actuator assembly, wherein the second retention assembly includes a second mechanical fastener;

moving the at least one hopper between a raised position and a lowered position based on an operation of the actuator assembly;

capturing the fixed end of the actuator within a first space defined by the first retention assembly in an event of failure of the first mechanical fastener; and capturing the movable end of the actuator within a second space defined by the second retention assembly in an event of failure of the second mechanical fastener.

18. The method of claim 17 further comprising positioning the actuator between the hopper frame and the at least one hopper externally relative to a material receiving space defined by the at least one hopper.

19. The method of claim 17 further comprising coupling the actuator assembly with the hopper frame and the at least one hopper such that the actuator is spaced apart from a sidewall of the at least one hopper along a longitudinal axis defined by the machine.

20. The method of claim 17 further comprising restricting a retraction of the actuator beyond a predefined limit based on abutment of a first limiting member coupled with the hopper frame with a second limiting member coupled with the at least one hopper.

* * * * *